US007896322B2

(12) United States Patent
Geler et al.

(10) Patent No.: US 7,896,322 B2
(45) Date of Patent: Mar. 1, 2011

(54) SIMPLE HIGH FORCE CLAMP

(75) Inventors: Manfred Geler, Puchhelm (DE); Ralf Strauβ, Worthsee (DE)

(73) Assignee: Irwin Industrial Tool Company GmbH, Hallbergmoos (DE)

( * ) Notice: Subject to any disclaimer, the term of this patent is extended or adjusted under 35 U.S.C. 154(b) by 1106 days.

(21) Appl. No.: 10/572,661

(22) PCT Filed: Dec. 8, 2004

(86) PCT No.: PCT/EP2004/013979

§ 371 (c)(1),
(2), (4) Date: Dec. 19, 2006

(87) PCT Pub. No.: WO2005/115690

PCT Pub. Date: Dec. 8, 2005

(65) Prior Publication Data

US 2007/0194510 A1 Aug. 23, 2007

(30) Foreign Application Priority Data

May 19, 2004 (DE) ..... 10 2004 024 862

(51) Int. Cl.
*B25B 1/00* (2006.01)

(52) U.S. Cl. ..... 269/6; 269/3; 269/95

(58) Field of Classification Search ..... 269/6, 3, 269/95, 228

See application file for complete search history.

(56) References Cited

U.S. PATENT DOCUMENTS

| | | | |
|---|---|---|---|
| 4,381,105 | A | 4/1983 | Goff et al. |
| 4,563,921 | A | 1/1986 | Wallace |
| 4,850,254 | A | 7/1989 | Burney |
| 4,874,155 | A | 10/1989 | Goul |
| 4,893,801 | A | 1/1990 | Flinn |
| 4,926,722 | A | 5/1990 | Sorensen et al. |
| 4,989,847 | A | 2/1991 | Chapman |
| 5,005,449 | A | 4/1991 | Sorensen et al. |
| 5,009,134 | A | 4/1991 | Sorensen et al. |
| 5,022,137 | A | 6/1991 | Sorensen et al. |
| D320,919 | S | 10/1991 | Sorensen |
| 5,094,131 | A | 3/1992 | Sorensen et al. |

(Continued)

FOREIGN PATENT DOCUMENTS

| | | |
|---|---|---|
| FR | 2611160 | 7/1994 |

(Continued)

OTHER PUBLICATIONS

"Pony Steel Bar Clamp Fixtures" styles 50, 52 and 56. Publication source and date unknown. It is believed that this publication was available to the public prior to Jul. 15, 1993.

(Continued)

*Primary Examiner* — Lee D Wilson
(74) *Attorney, Agent, or Firm* — Dennis J. Williamson; R. Brian Drozd; Moore & Van Allen PLLC

(57) ABSTRACT

A clamping and/or spreading tool including a push or pull rod, comprises at least one lock blocking displacement of the push or pull contrary to the clamping and/or spreading direction by it being canted by at least one biasing mechanism, such as a spring, relative to the push or pull rod, and a releasing mechanism which when actuated cancels the blocking effect of the lock such that the biasing mechanism and the releasing mechanism functionally engage the lock at least at opposite sides of the push or pull rod.

19 Claims, 8 Drawing Sheets

U.S. PATENT DOCUMENTS

| | | | | |
|---|---|---|---|---|
| 5,096,170 | A | 3/1992 | Albin | |
| D328,846 | S | 8/1992 | Sorensen et al. | |
| 5,161,787 | A | 11/1992 | Hobday | |
| 5,170,682 | A | 12/1992 | Sorensen et al. | |
| D333,963 | S | 3/1993 | Goodman | |
| 5,197,360 | A | 3/1993 | Wooster, Jr. | |
| 5,217,213 | A | 6/1993 | Lii | |
| 5,222,420 | A | 6/1993 | Sorensen et al. | |
| 5,454,551 | A | 10/1995 | Hobday | |
| D366,819 | S | 2/1996 | Wooster, Jr. et al. | |
| D366,820 | S | 2/1996 | Wooster, Jr. et al. | |
| 5,775,680 | A | 7/1998 | Sorensen et al. | |
| 5,826,310 | A | 10/1998 | Hobday | |
| 5,853,168 | A | 12/1998 | Drake | |
| 5,988,616 | A | 11/1999 | Fuller et al. | |
| 6,302,386 | B1 | 10/2001 | Fuller et al. | |
| 6,338,475 | B1 * | 1/2002 | Ping | 269/6 |
| 6,347,791 | B1 | 2/2002 | Chervenak | |
| 6,367,787 | B1 | 4/2002 | Poole et al. | |
| 6,382,608 | B1 * | 5/2002 | Michell | 269/6 |
| 6,386,530 | B1 * | 5/2002 | Marks | 269/6 |
| 6,412,767 | B1 | 7/2002 | Beckmann et al. | |
| 6,860,179 | B2 | 3/2005 | Hopper et al. | |
| 6,929,253 | B2 * | 8/2005 | Marks | 269/6 |
| 7,090,209 | B1 | 8/2006 | Rowlay | |
| 7,131,642 | B1 | 11/2006 | Rowlay et al. | |
| 7,624,974 | B2 * | 12/2009 | Zheng | 269/6 |
| 2004/0195746 | A1 * | 10/2004 | Marks | 269/6 |
| 2007/0194510 | A1 * | 8/2007 | Geler et al. | 269/6 |

FOREIGN PATENT DOCUMENTS

| | | |
|---|---|---|
| TW | 136083 | 6/1990 |

OTHER PUBLICATIONS

Bessey Steel Bar Clamp Fixture RS 75 instructions. Publication source and date unknown. It is believed that this publication was available to the public prior to Jul. 15, 1993.

Advertisement for Bessey Bar Clamps Styles 52, 53 and 56. Publication source and date unknown. It is believed that this publication was available to the public prior to Jul. 15, 1993.

Advertisement for Bessey Bar Clamps Styles 43 and 45. Publication source and date unknown. It is believed that this publication was available to the public prior to Jul. 15, 1993.

Advertisement for Gross Stabil Clamp. Publication source and date unknown. It is believed that this publication was available to the public prior to Jul. 15, 1993.

"Pony Clamp Fixtures" styles 50, 52, 53, and 56. "Jorgensen Style 3500 Aluminum Bar Clamps". "Jorgensen Style 7200 Steel I-Bar Clamps". Publication source and date unknown. It is believed that this publication was available to the public prior to Jul. 15, 1993.

"CATALOG—American Tool Companies, Inc.," advertisement of American Tool Companies, Inc., pp. 2-1 through 2-3 and 2-5 through 2-6. It is believed that the catalog was published in Oct. 1997.

* cited by examiner

SIMPLE HIGH FORCE CLAMP

The invention relates to a clamping and/or spreading tool including a push or pull rod.

The push or pull rod is displaceably mounted on a support of the clamping and/or spreading tool. The clamping and/or spreading tool has a fixed jaw fixedly connected to the support and a movable jaw fixedly connected to the push or pull rod, whereby the movable jaw can be moved relative to the fixed jaw by displacement of the push or pull rod.

For displacement of the push or pull rod and thus of the movable jaw an incremental gear mechanism is provided which comprises an actuating lever pivotally mounted on the support and an entraining element for canting by means of the actuating lever on the push or pull rod. The incremental gear mechanism is devised to convert the stroke of the actuating lever into an advance movement of the push or pull rod.

For clamping a workpiece the push or pull rod is displaced via the canted entraining element in the direction of the fixed jaw and away from the fixed jaw to generate the spreading forces. A lock prevents the push or pull rod from slipping back.

One such clamping and/or spreading tool having a proven record of success is known from DE 39 17 473 C2 in which the actuating lever is pivoted on a clamping side of the push or pull rod (the clamping side being defined as the side of the push or pull rod on which the clamping jaws are located). At an actuating side of the push or pull rod (the actuating side being defined as the side of the push or pull rod at which the actuating portion of the actuating lever is located) the actuating lever engages the entraining element configured as a rigid plate. A return spring acting on the entraining element causes the entraining element to cant in thus maintaining the entraining element at the actuating lever. Due to the incremental gear lever ratio of actuating lever arm, defined as the spacing of the pivoting point of the actuating lever from the force entry point of an operator at the actuating lever, to the active lever arm, defined as the spacing of the pivoting point of the actuating lever to the force entry point at the entraining element, a compromise is achieved between the relatively high clamping forces prompted at a workpiece to be clamped in place and relatively wide advance movements of the push or pull rod on an actuating stroke. A lock maintains the high clamping forces as may occur due to the blocking effect against displacement of the push or pull rod in the advance direction. In this arrangement of the known clamping and/or spreading tool there is the disadvantage that manually actuating the so-called reverse lock to release the high clamping forces can only be achieved with a lot of effort, it more particularly involving a sudden shock return of the push or pull rod.

On tools required to produce clamping forces in excess of 1000 Newton this sudden shock return of the push or pull rod from the advance direction on release of the clamping forces can be a nuisance or even cause injury to the operator.

Known from DE 197 31 579 A1 is a clamping and/or spreading tool for generating high clamping forces by comprising a displacable pivoting point of the actuating lever located at the actuating side. A reverse lock comprises a plate-type locking plate canted by a tension spring when non-actuated. Releasing the clamping forces at the locking plate is achieved by a separate trigger. On such tools too, the clamping forces are suddenly shock released at the reverse lock for which a relatively high force is needed.

It is the object of the invention to develop a clamping and/or spreading tool in which the force required to release the return lock is reduced.

To make only low operating forces necessary in ensuring simple use and especially in avoiding a sudden shock release of the clamping forces, one independent aspect of the invention involves in the clamping and/or spreading tool in accordance with the invention that displacement of the push or pull rod contrary to the clamping and/or spreading direction is blocked by a gear mechanism for displacement in the clamping and/or spreading direction and by a lock independent of the gear mechanism. A releasing means is devised in accordance with the invention to cancel the blocking effect of the gear mechanism and of the lock when actuated.

In one preferred embodiment of the invention the releasing means is devised, when actuated, to cancel the blocking effect of the gear mechanism and of the lock substantially simultaneously. As an alternative it may be provided for in accordance with the invention that the releasing means is devised to cancel the blocking effect of the gear mechanism and lock successively, particularly the blocking effect of the gear mechanism before the blocking effect of the lock. In successively cancelling of the locking cant, the releasing means may be devised to act in a predefined incremental release sequence on the gear mechanism and lock.

By providing two locks, namely that of the gear mechanism which permits displacement of the push or pull rod in the advance direction, namely in the clamping and/or spreading direction but blocks reverse displacement of the push or pull rod particularly automatically when the gear mechanism is not actuated by the operator, and that of a separate lock, in other words a lock independent of the operation of the gear mechanism, much higher clamping forces can now be maintained between the jaws than with known tools having only one lock.

Now, because in the embodiment in accordance with the invention only a low force needs to be applied to release the blocking effect, it having been discovered to be particularly of advantage to first release the blocking effect of the gear mechanism and then that of the lock.

In another preferred embodiment of the invention the blocking effect of the gear mechanism is prompted by an entraining element for displacing in the clamping and/or spreading direction is always canted by a biasing means, i.e. also in the non-actuated condition of the actuating lever, the biasing means and entraining element being adapted to each other so that no canting of the entraining element occurs relative to the push or pull rod following an actuating stroke and during return of an actuating lever of the gear mechanism. Canting of the entraining element results in no loss in the stroke of the actuating arm having to be accepted. Apart from this, the canting of the entraining element prevents the push or pull rod being displaced contrary to the advance direction when the gear mechanism is passive.

To achieve the desired sequence in releasing the lock, the lock is preferably configured more particularly, namely by the locking plate being urged by biasing means into a permanently canted position with respect to the push or pull rod so that any displacement contrary to the advance direction of the push or pull rod is prevented and the clamping forces generated between the clamping jaws are stored. Preferably, the biasing means is a spring, preferably a compression spring which may be configured as a coil spring or as a tension spring, engaging, on the one hand, the locking plate and, on the other supported or held by the support.

The releasing means may include a release lever which in accordance with the invention is releasably engageable with the lock. In this arrangement a third locking means is achievable in that the release lever is brought into the canted position relative to the push or pull rod in the same way as the entraining element via a biasing means. To release the triple lock the releasing sequence is definable by first releasing the blocking effect of the release lever.

Particularly low release forces and directing the clamping force particularly well from the workpiece to be clamped in place are achieved in that the releasing means is caused to engage the canted entraining element of the gear mechanism and the canted lock at opposite sides in each case, namely at the clamping side or actuating side of the push or pull rod in cancelling the canting achieving the blocking effect.

Then, even low release forces are sufficient when the releasing means acts on the entraining element of the gear mechanism, and on the lock at the side of the push or pull rod opposite an engaging location of the biasing means in each case. If, for example, the biasing means is arranged at the clamping side in producing a moment to pivot the entraining element or the lock into the canted position, the releasing means counteracts this moment at the opposite side by means of a large release lever arm. To achieve releasing, the canted entraining element or canted lock is pivot-returned about the engaging point of the biasing means.

In a preferred further embodiment of the invention the gear mechanism is designed to displace the push or pull rod in the clamping or spreading direction to produce high clamping forces. For this purpose the gear mechanism may comprise an actuating arm pivotally mounted at the clamping side of the push or pull rod in also engaging the entraining element at the clamping side in communicating the force.

In still another further embodiment of the invention the releasing means comprises a trigger or locking lever to which a component for communicating the actuating motion of the trigger is coupled, the component having a release action as regards the gear mechanism and lock when the trigger is actuated. In one preferred embodiment of the releasing means the trigger acts on the lock is directly cancelling the cant whilst the cant of the gear mechanism is cancelled via the component for communicating the actuating motion.

Preferably, the component can be configured as spring-tensioned bar mounted preferably for shifting in the longitudinal direction.

In yet another further embodiment of the invention the trigger is pivoted on a support shiftingly mounting the push or pull rod, the pivot mount of the trigger being arranged substantially level with the push or pull rod.

In another preferred, but also further independent aspect of the invention at least one plate or lock is pivoted about a fixed point of contact relative to a support of the clamping and/or spreading tool shiftingly mounting the push or pull rod for achieving the desired cant relative to the push or pull rod by a biasing means. The fixed point of contact may be positioned at the clamping side of the push or pull rod. In this arrangement the fixed point of contact about which the at least one plate of the lock is pivoted to produce the cant, and a further point of contact about which at least one entraining element plate of the gear mechanism is pivoted due to a biasing means such as a compression spring, to produce the cant with the push or pull rod, are arranged substantially level with the push or pull rod.

The clamping and/or spreading tool in accordance with the invention may be provided with at least one lock, preventing displacement contrary to the clamping or spreading direction by it being canted by at least one biasing means, such as a spring, particularly a coil spring, relative to the push or pull rod. By canting the at least one lock with the push or pull rod the clamping forces engaging a workpiece are maintained. Actuating the releasing means releases the lock. To reduce the force needed to release the lock, the biasing means and the releasing means are adapted to each other in accordance with the invention such that they engage the lock functionally at the opposite sides of the push or pull rod, namely the biasing means for canting the lock and the releasing means for releasing the blocking effect of the canted lock. This embodiment in accordance with the invention now makes it possible to provide the operator with a larger user-friendly actuating lever for releasing the lock. In accordance with the invention this achieves, on the one hand, that the releasing means engages the lock remote from the force entry point of the biasing means, on the other that the engaging point of the releasing means is remote from the cant of the lock and of the push or pull rod.

Preferably, the biasing means engages the lock at the actuating side of the push or pull rod and the releasing means at the clamping side of the push or pull rod. One particularly simple constructional embodiment for canting the lock relative to the pull rod is achieved in that the lock is pivoted by the biasing means about a fixed point located at the side of the push or pull rod opposite the side at which the engaging point of the releasing means is located.

In an alternative preferred embodiment of the invention the biasing means resulting in the lock being canted engages the lock at the clamping side of the push or pull rod and the releasing means for cancelling the cant is located at the actuating side of the push or pull rod.

In another independent aspect of the invention for improving the generic clamping and/or spreading tool, whereby this embodiment of the invention may also be viewed as a further embodiment of the aspect as already cited above, two biasing means, such as two compression springs, are provided for a lock of at least the one. One such pair of biasing means which maintains the lock in a canted position relative to the push or pull rod in reliably preventing reverse displacement of the push or pull rod also has the effect of preventing an undesirable displacement of the lock together comprising a displacement of the push or pull rod in the clamping or spreading direction when the incremental gear mechanism of the clamping and/or spreading tool is actuated. For this purpose, a first biasing means can be arranged at the actuating side of the push or pull rod and a second biasing means at the clamping side of the push or pull rod. It has namely been surprisingly discovered that the biasing means close to a fixed pivot point of the lock in particular ensures reliably canting of the lock whilst the biasing means located remote from the fixed pivot point mainly prevents the lock being included in the displacement when the incremental gear mechanism of the clamping and/or spreading tool is actuated.

Further advantages, features and properties of the invention will now be detained in the following description of preferred embodiments with reference to the attached drawings in which.

Figure 1:
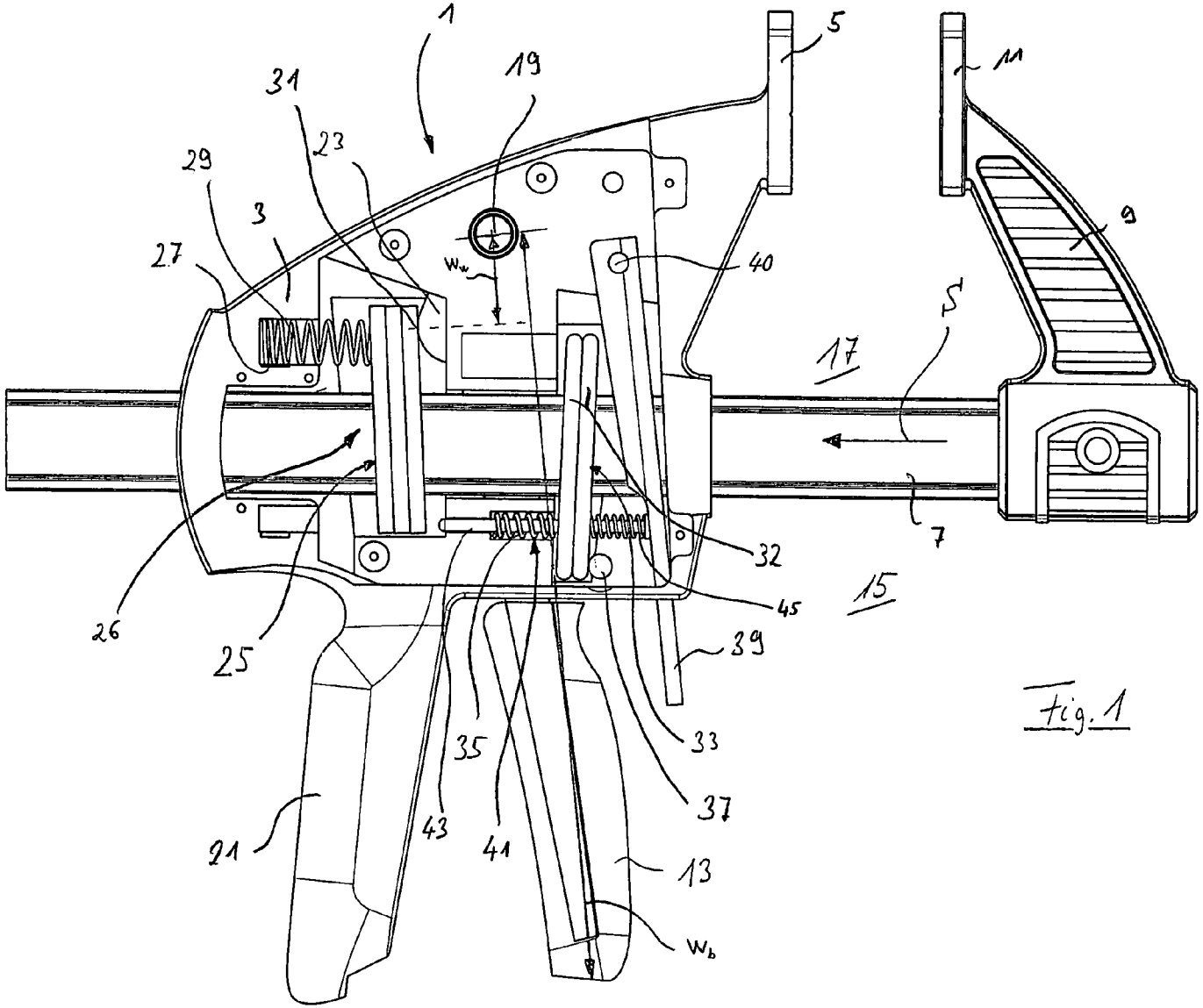
FIG. 1 is a side view of a first embodiment in accordance with the invention of a clamping and/or spreading tool in a first operating condition in which displacement of the push or pull rod is blocked contrary to the clamping direction S.
Figure 2:
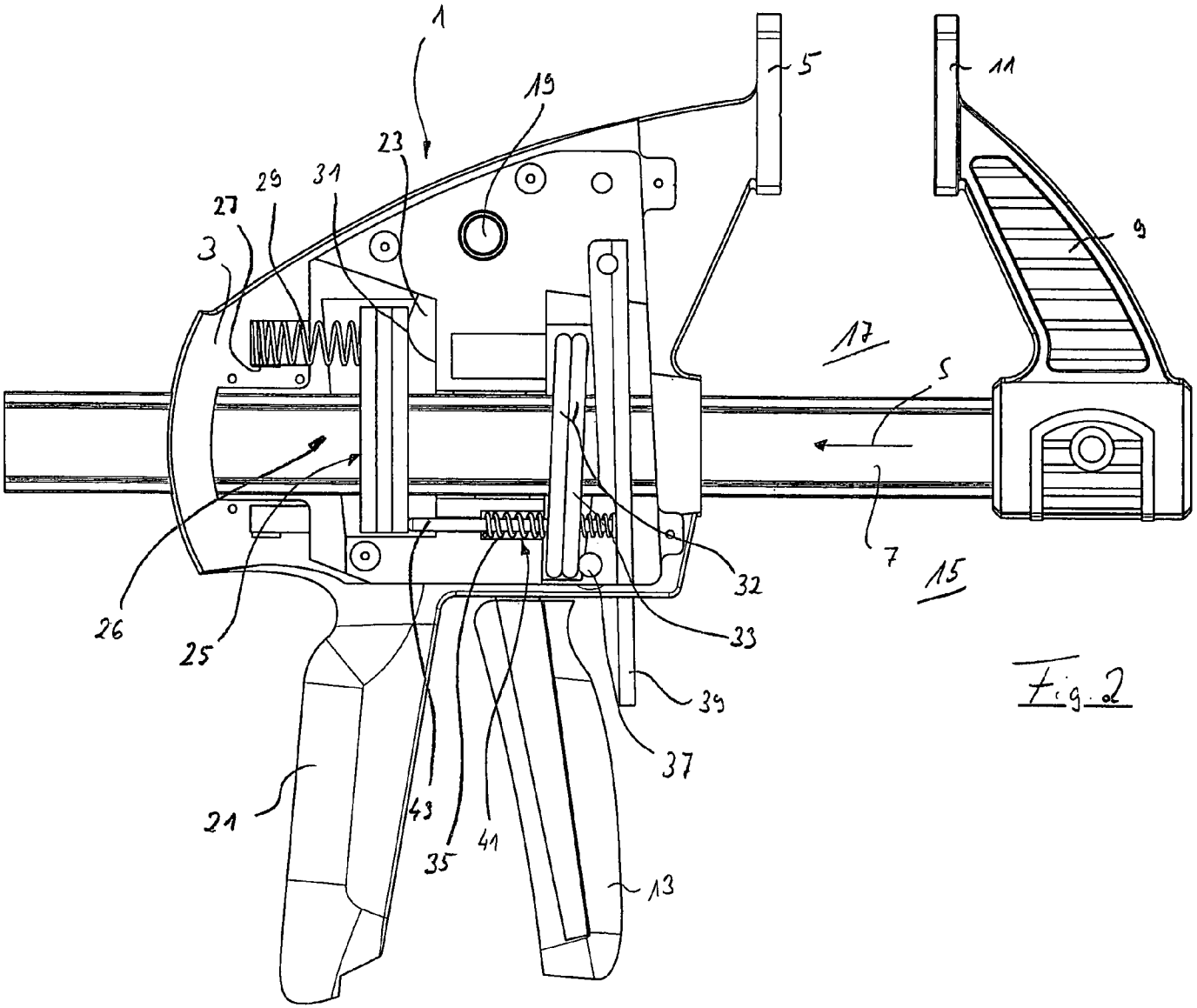
FIG. 2 is a view of the embodiment as shown in FIG. 1 but in a second operating condition in which a blocking effect of the gear mechanism is released and the blocking effect of the lock is active.
Figure 3:
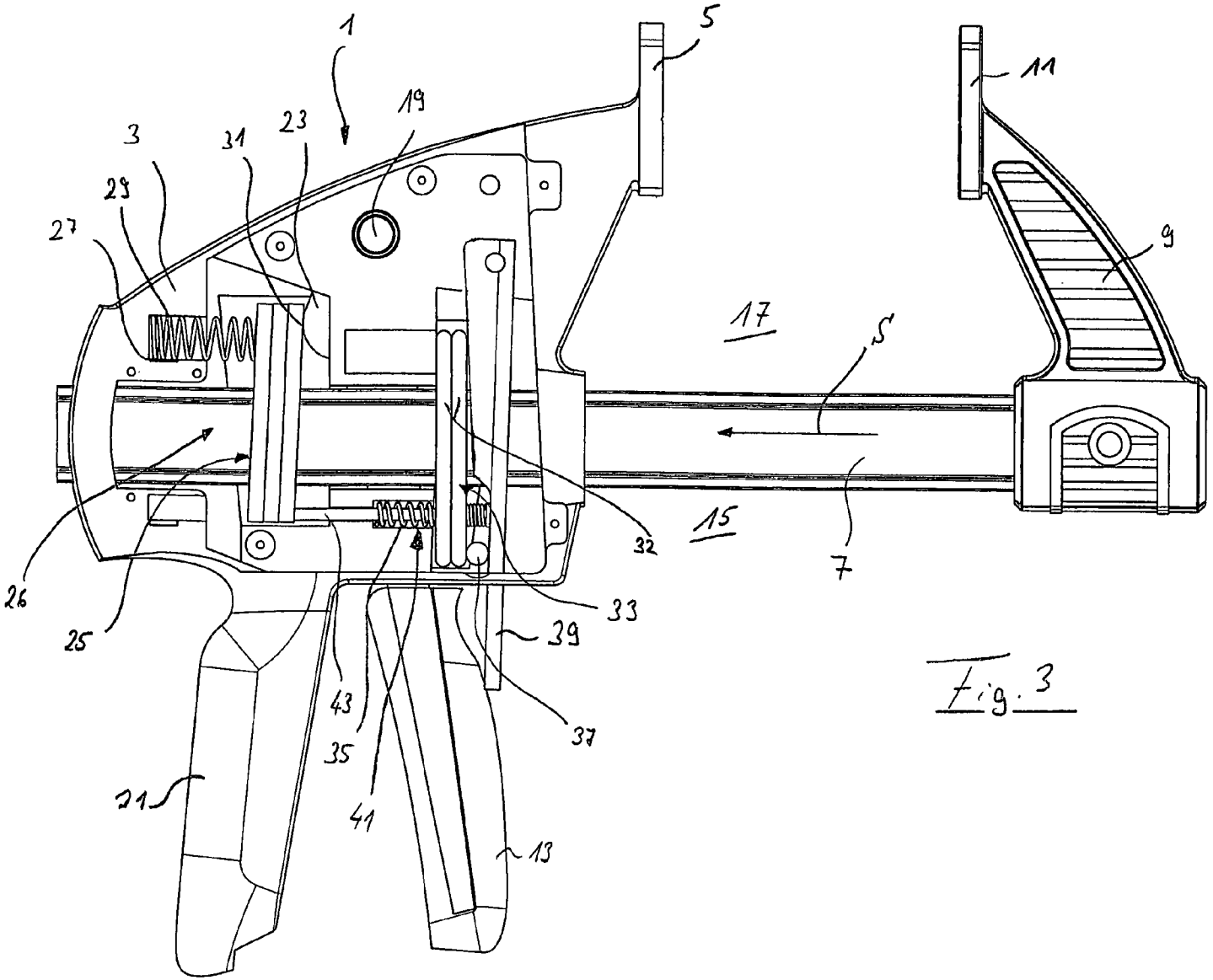
FIG. 3 is a view of the embodiment as shown in FIG. 1 and FIG. 2 in a third operating condition in which both the blocking effect of the gear mechanism and also that of the lock are released.

Referring now to FIGS. 1 to 3 there is illustrated a clamping tool 1 in accordance with the invention comprising a support 3 to which a fixed jaw 5 is fixedly connected and a push or pull rod 7 is mounted displaceably in the longitudinal direction of the push or pull rod 7. Releasably mounted at one end of the push or pull rod 7 is an arm 9, at the end of which a movable clamping jaw 11 is fixedly arranged diametrally opposite the fixed jaw 5, displacement of the push or pull rod 7 moving the movable clamping jaw 11 in the direction of the fixed jaw 5. When the arm 9 for mounting the clamping jaw 11 is arranged at the other end of the push or pull rod 7, the clamping and/or spreading tool has the function of a spreading tool.

The support 3 forms a housing in which components of an incremental gear mechanism are accommodated at least in part.

An actuating lever 13 extends from an actuating side 15 of the push or pull rod through one housing wall of the support 3 to a clamping side 17 of the push or pull rod 7 and is pivotally mounted by a pivot mount 19 on the support 3. For actuating the actuating lever 13 the operator (not shown) clasps the handle grip 21 by the palm of his hand and the actuating lever 13 by the fingers to pull the actuating lever 13 to the handle grip to implement an actuating stroke.

The actuating lever 13 includes an active arm 23 which is permanently in contact with a gear mechanism 26 taking the form of a entraining element 25 made up of three steel plates arranged in parallel. A compression coil spring 29 mounted in a blind hole 27 biases the entraining element 25 by exertion of a torque about a force entry point 31 of the active arm 23 into a position canted relative to the push or pull rod 7 so that any displacement of the push or pull rod 7 contrary to the clamping direction S is prevented, in other words in producing a blocking effect.

By the arrangement of the pivot mount 19 and handle grip 21 of the active arm 23 at the clamping side 17 of the push or pull rod 7 a lever ratio is created for the incremental gear mechanism as is defined by the ratio of the actuating lever arm $w_b$, defined by the spacing of an actuating range of the operator at the actuating lever 13 from the pivot mount 19, to the active lever arm $w_w$ and with which short advance movements of the push or pull rod 7 in the clamping direction S are achievable on an actuating stroke in thus attaining very high clamping forces in excess of 1000 Newton between the clamping jaws 5, 11 when clamping a workpiece (not shown); this lever ratio being, for example, 10:1.

To prevent return displacement of the push or pull rod 7 contrary to the clamping direction S, in addition to the permanently canted entraining element 25, a plate-type lock 33 comprising plates 32 are provided, the blocking effect of which is achieved with the aid of a compression spring 35 mounted by the support 3 which pivots the plate-type lock 33 into a canted position relative to the push or pull rod 7 by means of the fixed abutment 37 on the support 3.

When a workpiece is to be clamped by an operator between the fixed jaw 5 and movable clamping jaw 11 and high clamping forces exerted on the workpiece, the entraining element 25 and plate-type lock 33 serve to obtain the clamping forces engaging the workpiece.

To achieve release of the item without sudden shock return of the push or pull rod 7 with the jaw 11, the clamping tool 1 in accordance with the invention features a releasing means which is actuatable via a trigger 39 pivoted (40) at the support 3. In addition to the trigger 39 the release means 41 comprises a plunger 43 extending substantially parallel to the push or pull rod 7. This plunger 43 is fixedly secured to the trigger 39 and extends through the plate-type lock 33 or beyond the latter to the canted entraining element 25. A compression spring 45 has the task of bringing the trigger 39 into a passive position. The releasing means is devised, on actuation of the trigger 39, to release the blocking effect of the blocking components (25, 33) in succession, preferably the blocking effect of the canted entraining element 25 first being released, followed by release of the blocking effect of the plate-type lock 33. This is achieved in accordance with the embodiment as shown in FIG. 1 to support 3 by the spacing of the plunger 43 from the entraining element being adapted to the pivot angle spacing between the plate-type lock 33 and a portion of the trigger 39 near to the plate-type lock 33.

FIGS. 2 and 3 depict the various stages in which each of the locking parts is released.

Referring now to FIG. 2 there is illustrated the trigger 39 actuated roughly by half of its actuating stroke. The end of the plunger 43 facing the entraining element 25 comes into contact with the portion of the entraining element 25 located at the actuating side 15 and pivots the entraining element 25 about the force entry point 31 from its canted position into position substantially perpendicular to the push or pull rod 7 in which the push or pull rod would be displacable through the entraining element contrary to the clamping direction S. The forces released thereby are dissipated into the housing by flexing of the housing parts. In this position, however, displacement of the push or pull rod contrary to the clamping direction S is not yet possible, because displacement is obstructed by the still existing blocking effect of the plate-type lock 33 which continues to maintain at least part of the clamping forces between the clamping jaws. Consequently, the operator now experiences no sudden shock release of the forces on first-time release of the blocking effect of the entraining element 25.

Referring now to FIG. 3 there is illustrated the trigger 39 fully actuated so that part of the clamping side portion of the trigger 39 now engages a portion of the clamping side end of the plate-type lock 33 in thus pivoting the plate-type lock 33 to release the cant and clamping forces. Because of the spacing between the engaging location of the trigger 39 and of the compression spring 35 only a minor force is now needed for release even when high clamping forces are involved.

Since part of the clamping forces is already released by release of the entraining element 25, releasing blocking of the plate-type lock 33 now results in a force being dissipated which is hardly noticed by the operator.

Figure 4:
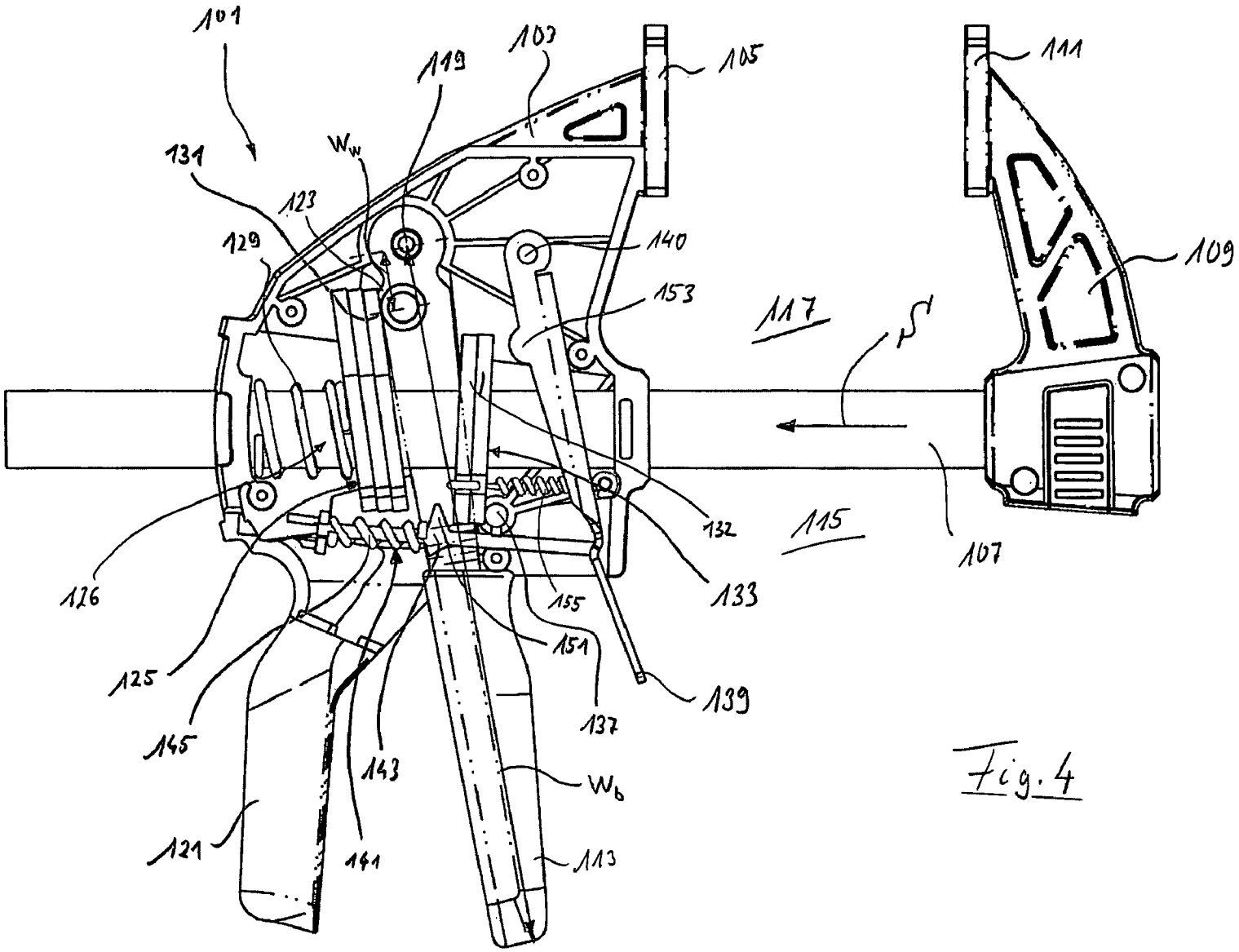
FIG. 4 is a side view of the embodiment of a second embodiment in accordance with the invention of a clamping and/or spreading tool showing the function component housing open in a first operating condition in which displacement of the push or pull rod is blocked contrary to the clamping direction S.
Figure 5:
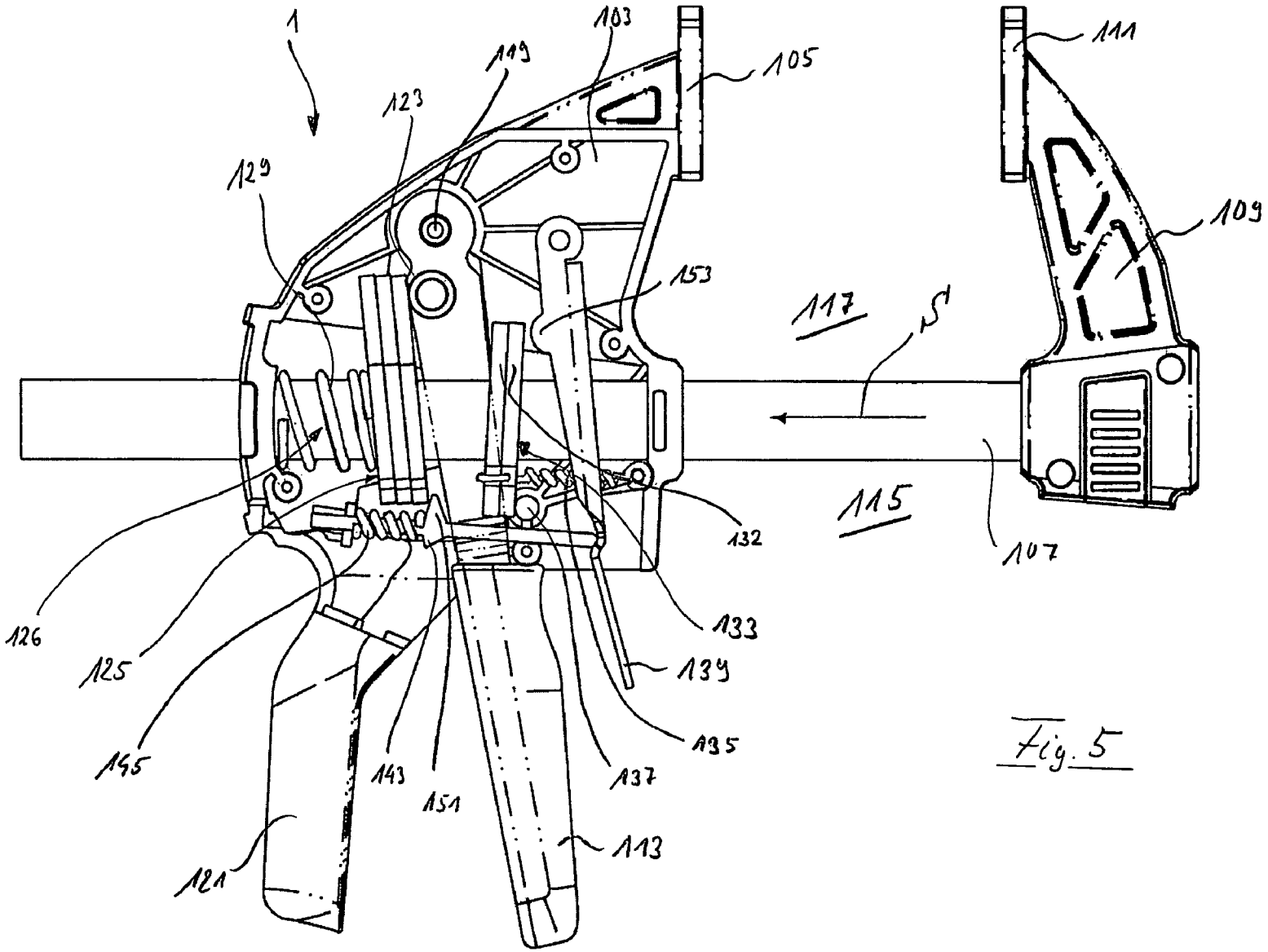
FIG. 5 is a view of the embodiment as shown in FIG. 3 but in a second operating condition in which a blocking effect of the gear mechanism is released and the blocking effect of the lock is active.
Figure 6:
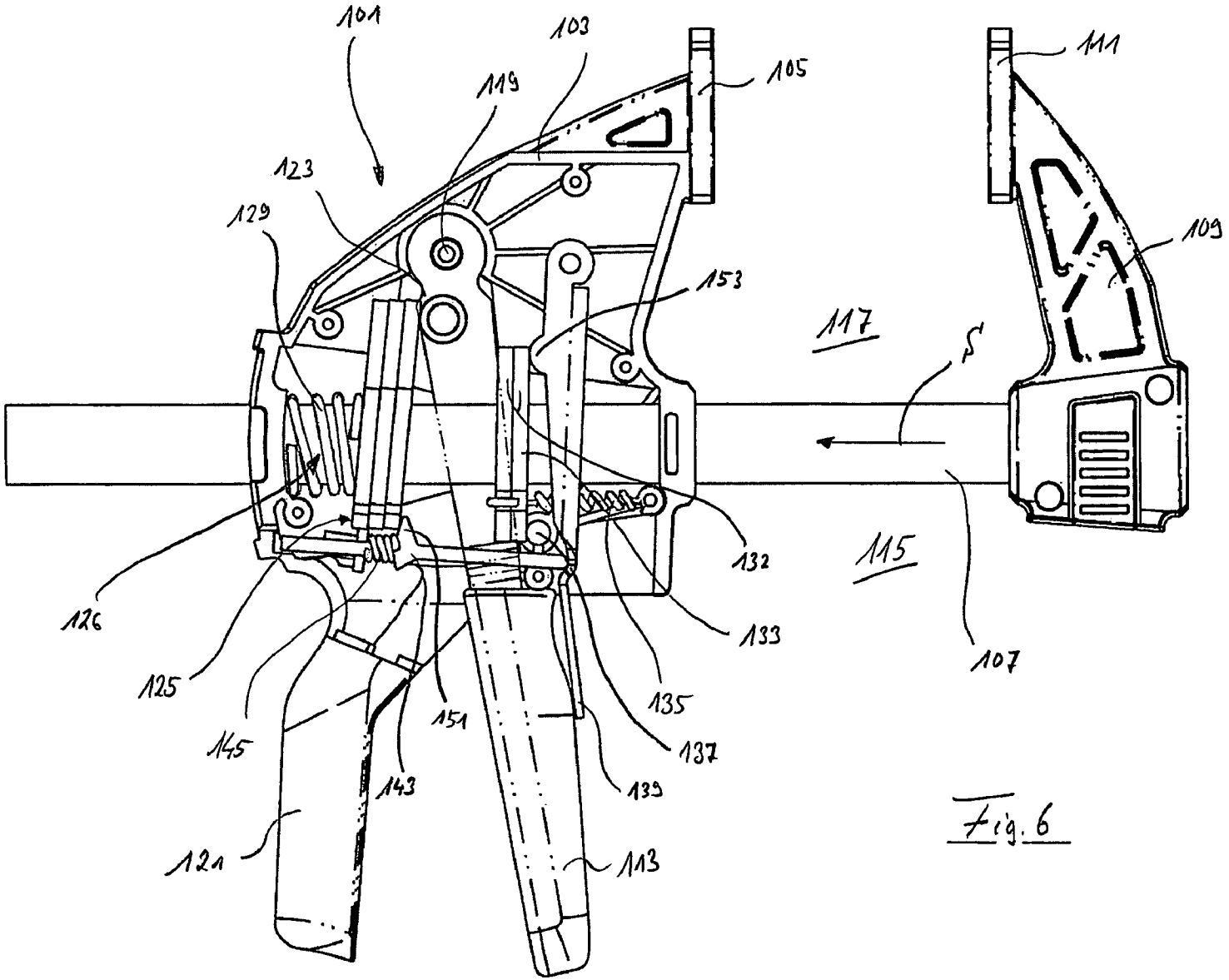
FIG. 6 is a view of the embodiment as shown in FIGS. 2 and 3 in a third operating condition in which both the blocking effect of the gear mechanism and also that of the lock are released.

Referring now to FIGS. 4 to 6 there is illustrated a further embodiment in accordance with the invention. To facilitate appreciating the description of these FIGS. like or similar components to those as shown in FIGS. 1 to 3 are identified by like reference numerals, but elevated by 100.

The clamping tool 101 differs from the clamping tool 1 as shown in FIGS. 1 to 3 in that the lock or plate-type lock 133 is not canted by a compression spring seated in a mount, but instead by means of a tension spring mounted at one end of the support and engaging a hole drilled in the plate-type lock 133 at the other end.

A further different feature worthy of mention is the arrangement of compression spring 145 which has the task of bringing the trigger 139 into a passive position. In the embodiment as shown in FIGS. 4 to 6 the compression spring 145 is no longer supported by the plate-type lock 133 but by the support 103.

The plunger 143 no longer comes into contact with the entraining element 125 of the gear mechanism 126 at the end thereof, instead the plunger 143 is provided with an entraining protuberance 151 protruding in the direction of the push-rod for freely engaging the cant of the portion of the entraining element 125 at actuating side.

Referring now to FIG. 5 there is illustrated how actuation of the trigger 139 first brings the protuberance 151 into engagement with the entraining element whilst a bump 153 of the trigger at the clamping side is remote from the plate-type lock 133, whereas in FIG. 6 the fully released position is shown because the free trigger 139 also releases the cant of the plate-type lock.

The clamping tool as shown in FIGS. 4 to 6 features an incremental gear mechanism with which still higher clamping forces are attainable than with the clamping tool as shown in FIGS. 1 to 3. This is because the active lever arm $w_w$ as compared to the actuating lever arm $w_b$ is still small in thus achieving extremely favorable lever ratios of 12:1 for producing high clamping forces.

The embodiments as shown in FIGS. 1 to 3 and 4 to 6 may, in addition to the plate-type lock 33, 133, feature a further locking component acting to displace the push or pull rod 7, 107 contrary to the clamping direction S by the trigger 39, 139 being canted by spring 42, 145 relative to the push or pull rod 7, 107 in thus blocking displacement of the push or pull rod 7, 107 contrary to the clamping direction S. In this case, actuating the trigger 39, 139 releases the blocking effect of the trigger 39, 109 first of all.

Figure 7:
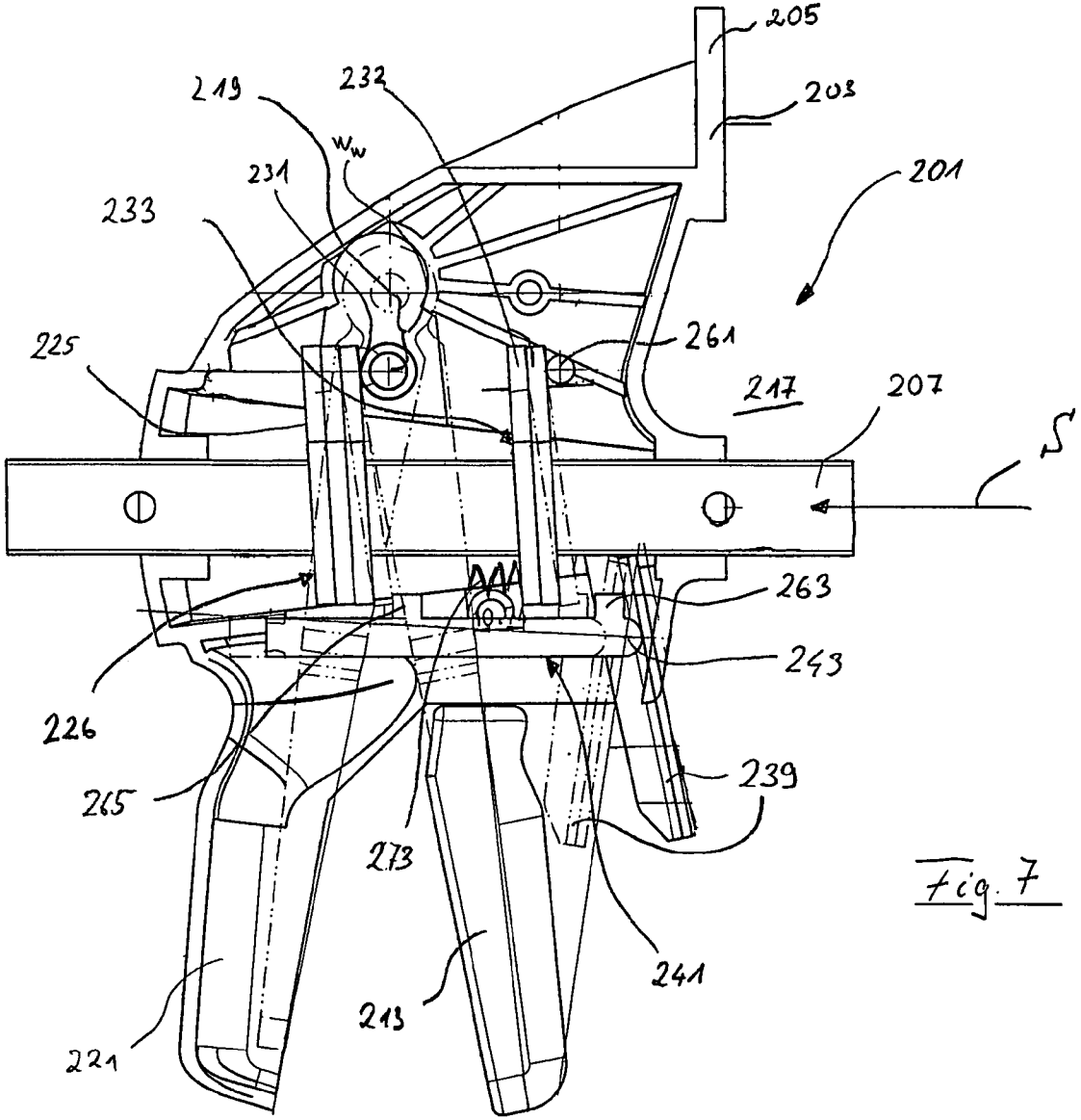
FIG. 7 is a side view of a third embodiment in accordance with the invention of a clamping and/or spreading tool showing the functional component housing open in a passive operating condition.

Referring now to FIG. 7 there is illustrated a further embodiment in accordance with the invention of a clamping and/or spreading tool. To facilitate appreciating the description of the FIGS. like or similar components to those as shown in FIGS. 1 to 6 are identified by like reference numerals, but elevated by 100 and 200 respectively.

The clamping tool 202 differs substantially from the embodiments as described above by a different lock or plate-type lock 233 and a different release means 241 being provided.

The plate-type lock 233 comprises two plates 232 which are canted by a biasing means in the form of a compression spring 273 relative to the push or pull rod as indicated diagrammatically. By means of the compression spring 273 the plates 232 of the plate-type lock 233 are pivoted about a fixed abutment 261 fixedly mounted on the support 203 of the clamping tool 202, the fixed abutment 261 being located at the clamping side 217 of the push or pull rod 207.

To provide substantially the same lever ratios for releasing the plate-type lock 233 comprising a gear mechanism 226 exerting a blocking effect, the fixed abutment 261 is located level with the push or pull rod 207 as the force entry point 231 of the actuating lever 213 about which the entraining elements 225 forming the gear mechanism 226 are pivoted by means of a compression coil spring (not shown).

The release means 241 in accordance with the invention comprises a plunger 243 displaceable parallel to the push or pull rod 207. The plunger 243 comprises two protuberances 263, 265 which on actuation of the release means 241 cooperate with the plates 232 and entraining element 225 respectively for decanting, by the latter being pivoted back in defeating the effect of the biasing means in each case.

The release means 241 is shown in two operating conditions, the passive operating condition being indicated by the solid line whilst the activated condition, in other words releasing the blocking effect of the plate-type lock 233 and of the canted entraining elements 225, is indicated dot-dashed.

When the trigger 239 is pivoted about a pivot mount (not shown) level with the push or pull rod 207 in the direction of the actuating lever 213, the plunger 243 is displaced in the clamping direction S. In this arrangement the protuberances 263 and 265 are disposed relative to the plates 232 and entraining elements respectively such that the blocking effect of the plate-type lock as well as of the gear mechanism 226 is cancelled substantially at the same time. Simultaneously cancelling the blocking effects is achieved structurally by the spacing of the protuberances 263 and 265 respectively in the clamping direction S from the plates 232 of the plate-type lock 233 or from the entraining elements 225 of the gear mechanism 226 is substantially equal.

Figure 8:
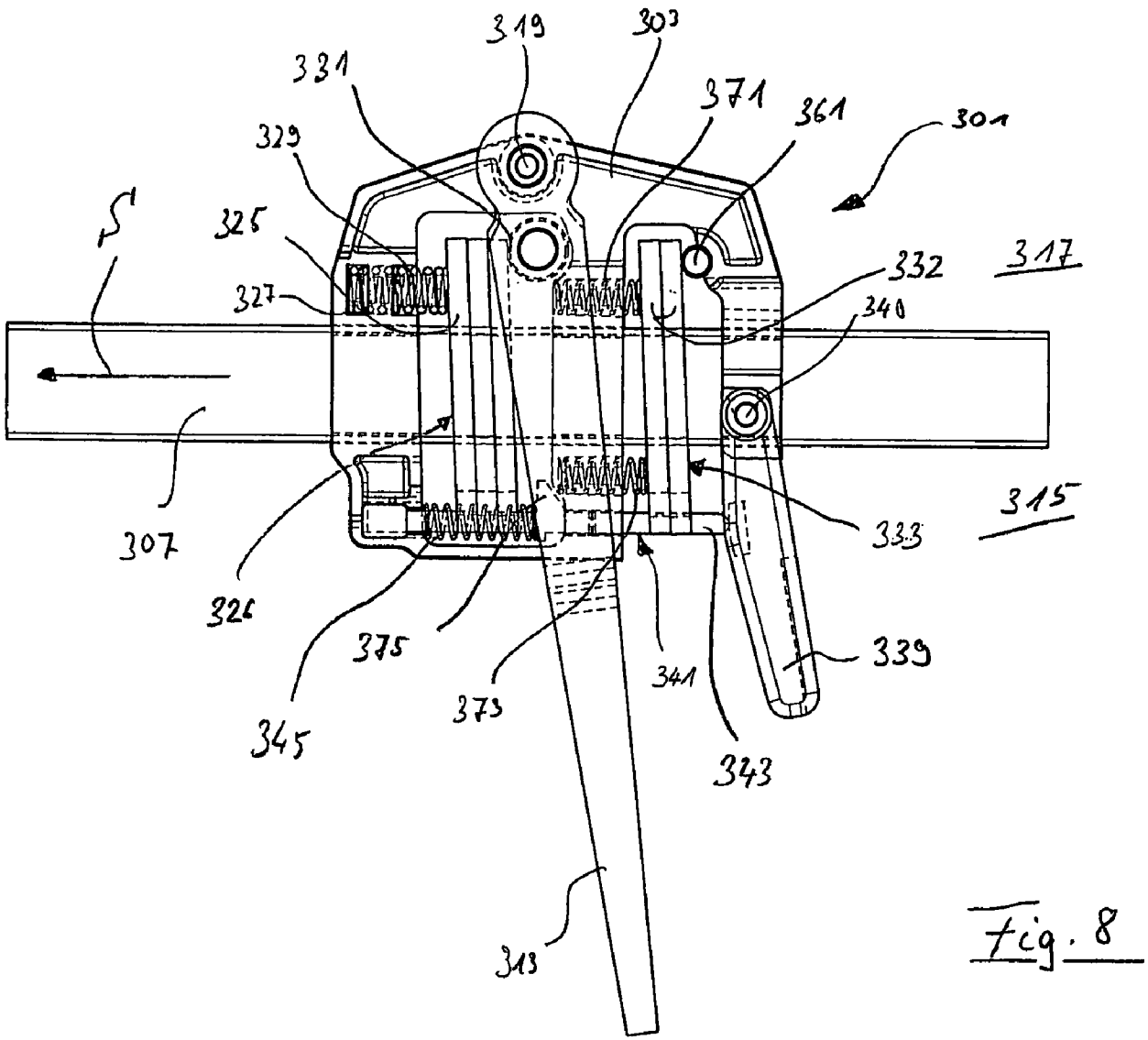
FIG. 8 is a side view of a fourth embodiment in accordance with the invention of a clamping and/or spreading tool showing the functional component housing open in an passive operating condition.

Referring now to FIG. 8 there is illustrated yet a further embodiment of the clamping tool in accordance with the invention. To facilitate appreciating the description of this FIG. like or similar components to those as shown in FIGS. 1 to 7 are identified by like reference numerals, but elevated by 100, 200 and 300 respectively.

The clamping tool 301 differs from the clamping tool 201 as shown in FIG. 7 more particularly by the plate-type lock 333 and release means 341 being configured differently.

The plate-type lock 333 comprises two biasing means configured as compression springs 371 and 373, resulting in the plates 332 being pivoted about the fixed abutment 361. The compression springs 371 at the clamping side 317 of the push or pull rod 307 achieve reliable canting of the plates 332 relative to the push rod 307 to ensure a reliable blocking action against return of the push rod 307.

The compression spring 373 at the actuating side 315 of the push or pull rod 307 prevents entrained displacement of the plates 332 of the plate-type lock 333 as soon as the gear mechanism 326 is actuated by the actuating lever 313 and the push or pull rod 307 is displaced in the clamping direction S. The plates 332 thus permanently remain in contact with the abutment 361.

The release means 341 comprises just a single protuberance 375 engageable with the canted entraining elements 325 of the gear mechanism 326 in cancelling the blocking effect thereof as soon as the trigger 339 of the release means 341 is actuated strongly enough.

The protuberance 375 also serves as an abutment for a compression spring 345 which urges the plunger 343 back into its passive starting position, as shown in FIG. 8.

Actuating the trigger 339 shifts the plunger 343 in the clamping direction S in simultaneously cancelling the blocking effect of the entraining elements 325 and of the plates 332. Cancelling the blocking effect of the plate-type lock 333 is directly caused by engagement of the trigger 339 at the lower end of the plates 332.

Achieving simultaneously cancelling of the blocking effect is due to the spacing of the trigger from the plates 332 as well as of the protuberance 375 from the entraining elements 325 being substantially the same.

It is understood that the features disclosed in the present description, FIGS. and claims may be of significance both singly as well as in any combination for achieving the invention in its various aspects.

The invention claimed is:

1. A clamping and/or spreading tool comprising:

a rod, an entraining mechanism for displacing said rod in a first direction and for blocking displacement of the rod in a second direction opposite to the first direction;

a lock, independent of said entraining mechanism, for blocking displacement of said rod in said second direction, and a releasing means for canceling the blocking effect of said entraining mechanism and of said lock.

2. The clamping and/or spreading tool of claim 1, wherein said releasing means cancels the blocking effect of said entraining mechanism and of said lock substantially simultaneously.

3. The clamping and/or spreading tool of claim 1, wherein said releasing means cancels the blocking effect of said entraining mechanism and of said lock successively.

4. The clamping and/or spreading tool of claim 1, wherein said releasing means comprises a trigger and further comprising a plunger operatively connected to said trigger where said plunger moves said entraining mechanism and lock to a non-blocking position when said trigger is actuated.

5. The clamping and/or spreading tool of claim 1, wherein said releasing means comprises a trigger and further comprising a plunger operatively connected to said trigger where said plunger moves said entraining mechanism and said trigger moves said lock to a non-blocking position when said trigger is actuated.

6. The clamping and/or spreading tool of claim 1, wherein said releasing means comprises a trigger, said trigger is pivotally mounted on a support at a pivot mount, said support displacingly mounting said rod, the pivot mount of said trigger being located substantially level with said rod.

7. The clamping and/or spreading tool of claim 1, wherein in addition to said entraining mechanism and said lock at least one further locking part counteracting displacement of said rod in said second direction is provided, said locking part being releasable before release of said entraining mechanism and formed by a trigger acting on said lock and entraining mechanism, said trigger comprising a passive locking position and one or more active release positions.

8. The clamping and/or spreading tool of claim 1, wherein said lock comprises a plate that is canted by at least one spring relative to said rod, said releasing means moving said plate against the spring, said plate being pivoted about a point fixed relative to said support, and said entraining mechanism comprising at least one entraining plate, said entraining plate being pivoted about a second fixed point relative to said support, wherein said fixed point about which the plate of said lock is pivoted and the second fixed point about which the at least one entraining plate is pivoted are arranged at substantially the same level relative to the rod.

9. The clamping and/or spreading tool of claim 8, wherein the spring and said releasing means engage said lock on opposite sides of said rod.

10. The clamping and/or spreading tool of claim 9, wherein the spring engages said lock on an actuating side of said rod and said releasing means engages said lock on a clamping side of said rod.

11. The clamping and/or spreading tool of claim 9, wherein the spring engages said lock on a clamping side of said rod and said releasing means engages said lock on an actuating side of said rod.

12. The clamping and/or spreading tool of claim 8, wherein a second spring is provided for canting said lock, the first spring being arranged at said actuating side of said rod and the second spring being arranged at said clamping side of said rod.

13. A clamping and/or spreading tool comprising;

a rod, an entraining mechanism movable between a first position for displacing said rod in a first direction and for blocking displacement of the rod in a second direction opposite to the first direction and a second position for allowing displacement of the rod in the second direction;

a lock, independent of said entraining mechanism, movable between a third position for blocking displacement of said rod in said second direction and a fourth position for allowing displacement of the rod in the second direction; and a trigger movable between a passive position and an actuated position, said trigger operatively connected to the entraining mechanism and the lock to move the entraining mechanism from the first position to the second position and the lock from the third position to the fourth position when the trigger is moved from the passive position to the actuated position.

14. The clamping and/or spreading tool of claim 13 wherein the trigger directly contacts the lock as the trigger moves from the passive position to the actuated position.

15. The clamping and/or spreading tool of claim 13 wherein the trigger contacts the entraining mechanism through a plunger as the trigger moves from the passive position to the actuated position.

16. The clamping and/or spreading tool of claim 13 wherein the trigger contacts the entraining mechanism and the lock through a plunger as the trigger moves from the passive position to the actuated position.

17. The clamping and/or spreading tool of claim 13 wherein the entraining mechanism comprises at least one first plate that is canted relative to the rod in the first position and the lock comprises at least one second plate that is canted relative to the rod in the third position.

18. The clamping and/or spreading tool of claim 17 further comprising a first spring for biasing the at least one first plate to the first position and a second spring for biasing the at least one second plate to the third position.

19. The clamping and/or spreading tool of claim 13 further comprising a plunger in operative engagement with the trigger for moving with the trigger, a first spring between the plunger and the lock for biasing the lock to the third position when the trigger is in the passive position and for allowing the lock to move to the fourth position when the trigger is moved from the passive position to the actuated position, said plunger moving the entraining mechanism from the first position to the second position when the trigger is moved from the passive position to the actuated position.

* * * * *

UNITED STATES PATENT AND TRADEMARK OFFICE

CERTIFICATE OF CORRECTION

PATENT NO. : 7,896,322 B2
APPLICATION NO. : 10/572661
DATED : March 1, 2011
INVENTOR(S) : Manfred Geier et al.

It is certified that error appears in the above-identified patent and that said Letters Patent is hereby corrected as shown below:

On the cover page, please change the inventor in item (12) from "Geler et al." to --Geier et al.--; and On the cover page, please change the first inventor in item (75) from "Manfred Geler" to --Manfred Geier--.

Signed and Sealed this
Third Day of May, 2011

David J. Kappos

David J. Kappos
*Director of the United States Patent and Trademark Office*